US012140157B1

(12) United States Patent
Hsu et al.

(10) Patent No.: US 12,140,157 B1
(45) Date of Patent: Nov. 12, 2024

(54) FAN FRAME

(71) Applicant: Delta Electronics, Inc., Taoyuan (TW)

(72) Inventors: Kuo-Tung Hsu, Taoyuan (TW); Jen-Bo Huang, Taoyuan (TW); Chao-Fu Yang, Taoyuan (TW); Yu-Lun Weng, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 18/344,119

(22) Filed: Jun. 29, 2023

(30) Foreign Application Priority Data

May 11, 2023 (CN) ..... 202310529143.0

(51) Int. Cl.
*F04D 29/52* (2006.01)
*F04D 19/00* (2006.01)

(52) U.S. Cl.
CPC ..... *F04D 29/522* (2013.01); *F04D 19/002* (2013.01)

(58) Field of Classification Search
CPC ..... F04D 29/52; F04D 19/002
See application file for complete search history.

(56) References Cited

U.S. PATENT DOCUMENTS

| | | | | |
|---|---|---|---|---|
| 6,710,486 | B1 * | 3/2004 | Horng | F04D 29/667 310/59 |
| 2006/0045744 | A1 * | 3/2006 | Chen | F04D 29/542 416/189 |
| 2006/0045774 | A1 * | 3/2006 | Lu | F04D 29/545 417/423.7 |
| 2006/0147305 | A1 * | 7/2006 | Horng | F04D 29/325 415/220 |
| 2007/0031248 | A1 * | 2/2007 | Hsu | F04D 29/544 415/191 |
| 2008/0310952 | A1 * | 12/2008 | Lin | F04D 29/526 415/121.2 |
| 2010/0074746 | A1 * | 3/2010 | Huang | F04D 29/601 415/220 |
| 2014/0112810 | A1 * | 4/2014 | Chou | F04D 29/584 417/423.12 |
| 2022/0163051 | A1 | 5/2022 | Hsu et al. | |

FOREIGN PATENT DOCUMENTS

| | | |
|---|---|---|
| CN | 1972084 A | 5/2007 |
| CN | 103696987 A | 4/2014 |
| TW | 200706764 | 2/2007 |

* cited by examiner

*Primary Examiner* — Long T Tran
(74) *Attorney, Agent, or Firm* — MUNCY, GEISSLER, OLDS & LOWE, PC

(57) ABSTRACT

A fan frame includes a housing, a shaft seat, a curved rib, a plurality of first ribs, and a plurality of second ribs. The shaft seat is disposed at the center of the housing. The curved rib is disposed between the housing and the shaft seat. The first ribs extend through the curved rib and connect the shaft seat to the housing, and the second ribs connect the curved rib to the shaft seat.

12 Claims, 11 Drawing Sheets

FAN FRAME

CROSS REFERENCE TO RELATED APPLICATIONS

This application claims priority of China Patent Application No. 202310529143.0 filed on May 11, 2023, the entirety of which is incorporated by reference herein.

BACKGROUND OF THE INVENTION

Field of the Invention

The present invention relates to a fan frame, and, in particular, to a fan frame of an axial fan device.

Description of the Related Art

As the axial fan can have low air pressure and high air volume to facilitate uniform air flow distribution within a specific region, it has been widely used in heat dissipation for electronics. The fan frame of a conventional axial fan usually has a shaft seat, a housing, and three ribs connecting the shaft seat to the housing for providing a large airflow area.

However, due to the simple and weak structure of the conventional fan frame, the fan frame may deform during usage, leading to variations in the flow rate within the airflow area, and generating an annoying noise.

Therefore, it has become a challenge to prevent deformation of the fan frame, reduce flow-rate variation, and eliminate noise during operation.

BRIEF SUMMARY OF THE INVENTION

An embodiment of the present invention provides a fan frame that includes a housing, a shaft seat, at least one curved rib, a plurality of first ribs, and a plurality of second ribs. The housing has an air inlet and an air outlet, wherein the air inlet is on the first side of the housing, and the air outlet is on the second side of the housing. The shaft seat is disposed at the center of the housing. The curved rib is disposed between the housing and the shaft seat. The first ribs extend through the curved rib and connect the shaft seat to the housing, wherein the first ribs and the curved rib define a plurality of first holes. The second ribs connect the curved rib to the shaft seat, wherein the second ribs and the curved rib define a plurality of second holes, wherein the first and second holes form the airflow area of the fan frame.

Air flows through the air inlet along the air-inlet direction, and air is discharged from the fan frame through the air outlet along the air-outlet direction that is the same as the air-inlet direction.

In some embodiments, the first ribs are arranged around the shaft seat in a symmetrical manner.

In some embodiments, the shaft seat has a center point, and when taking the center point as the origin of an angular coordinate, one of the first ribs is located between and adjacent to another two of the first ribs, wherein a first included angle and a second included angle are defined by the three first ribs, and the first included angle is not equal to the second included angle.

In some embodiments, the second ribs are arranged around the shaft seat in a symmetrical manner and located between the inner side of the curved rib and the outer side of the shaft seat.

In some embodiments, the shaft seat has a center point, and when taking the center point as the origin of an angular coordinate, a third included angle is formed between one of the second ribs and one of the first ribs that are close to each other, and a fourth included angle is formed between another one of the second ribs and another one of the first ribs that are close to each other, wherein the fourth included angle is not equal to the third included angle.

In some embodiments, the curved rib is divided into a plurality of arc portions by the first ribs, and the arc portions have the same length.

In some embodiments, the curved rib is divided into a plurality of arc portions by the first ribs, and at least one of the arc portions has a different length than the other arc portions.

In some embodiments, the curved rib is divided into a plurality of arc portions by the first ribs, and the shaft seat has a center point, wherein when taking the center point as the origin of an angular coordinate, at least one of the arc portions has a radius with respect to the center point that is greater than the other arc portions.

In some embodiments, the fan frame further includes an auxiliary curved rib disposed between the curved rib and the shaft seat.

In some embodiments, the first and second ribs are arranged around the shaft seat in a staggered manner.

In some embodiments, two of the second ribs are located between two of the first ribs that are adjacent to each other.

In some embodiments, the curved rib forms an opening, and a connector hole is formed between the opening and the housing.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The making and using of the embodiments of the fan frame are discussed in detail below. It should be appreciated, however, that the embodiments provide many applicable inventive concepts that can be embodied in a wide variety of specific contexts. The specific embodiments discussed are merely illustrative of specific ways to make and use the embodiments, and do not limit the scope of the disclosure.

Unless defined otherwise, all technical and scientific terms used herein have the same meaning as commonly understood by one of ordinary skill in the art to which this invention belongs. It should be appreciated that each term, which is defined in a commonly used dictionary, should be interpreted as having a meaning conforming to the relative skills and the background or the context of the present disclosure, and should not be interpreted in an idealized or overly formal manner unless defined otherwise.

In the following detailed description of the preferred embodiments, reference is made to the accompanying drawings, and in which specific embodiments of which the invention may be practiced are shown by way of illustration. In this regard, directional terminology, such as "top," "bottom," "left," "right," "front," "back," etc., is used with reference to the orientation of the figures being described. The components of the present invention can be positioned in a number of different orientations. As such, the directional terminology is used for the purposes of illustration and is in no way limiting.

Figure 1:
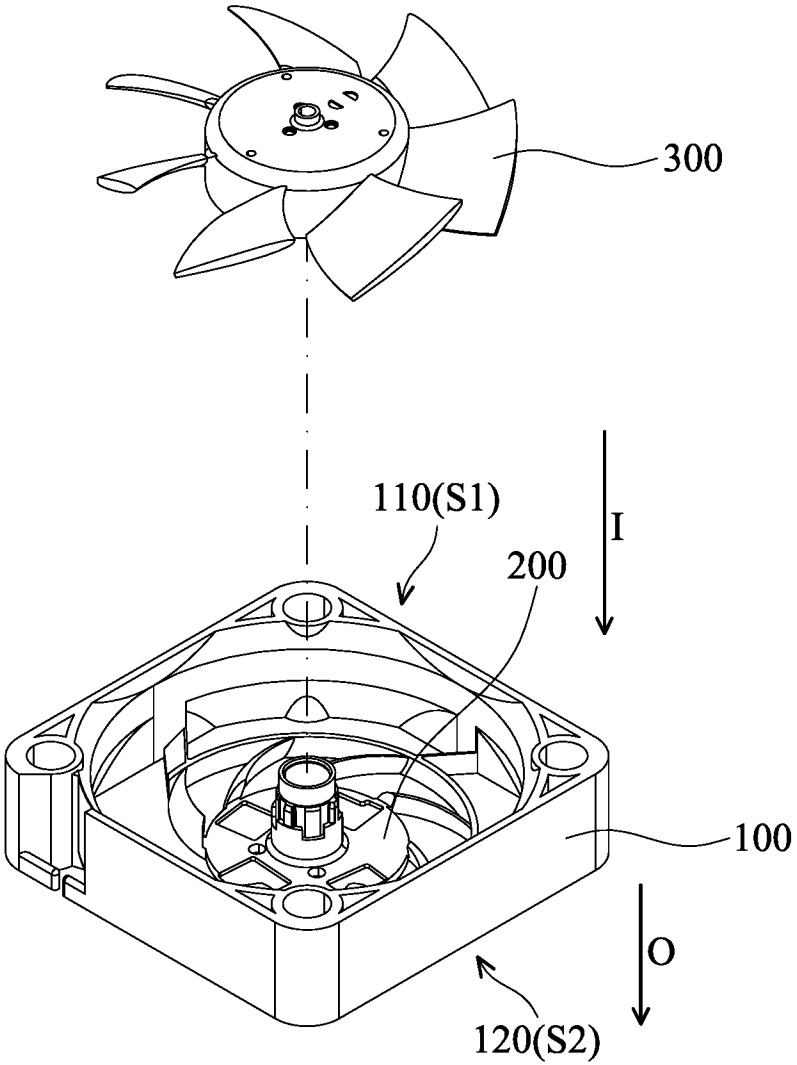
FIG. 1 is an exploded diagram of an axial fan device.
Figure 2:
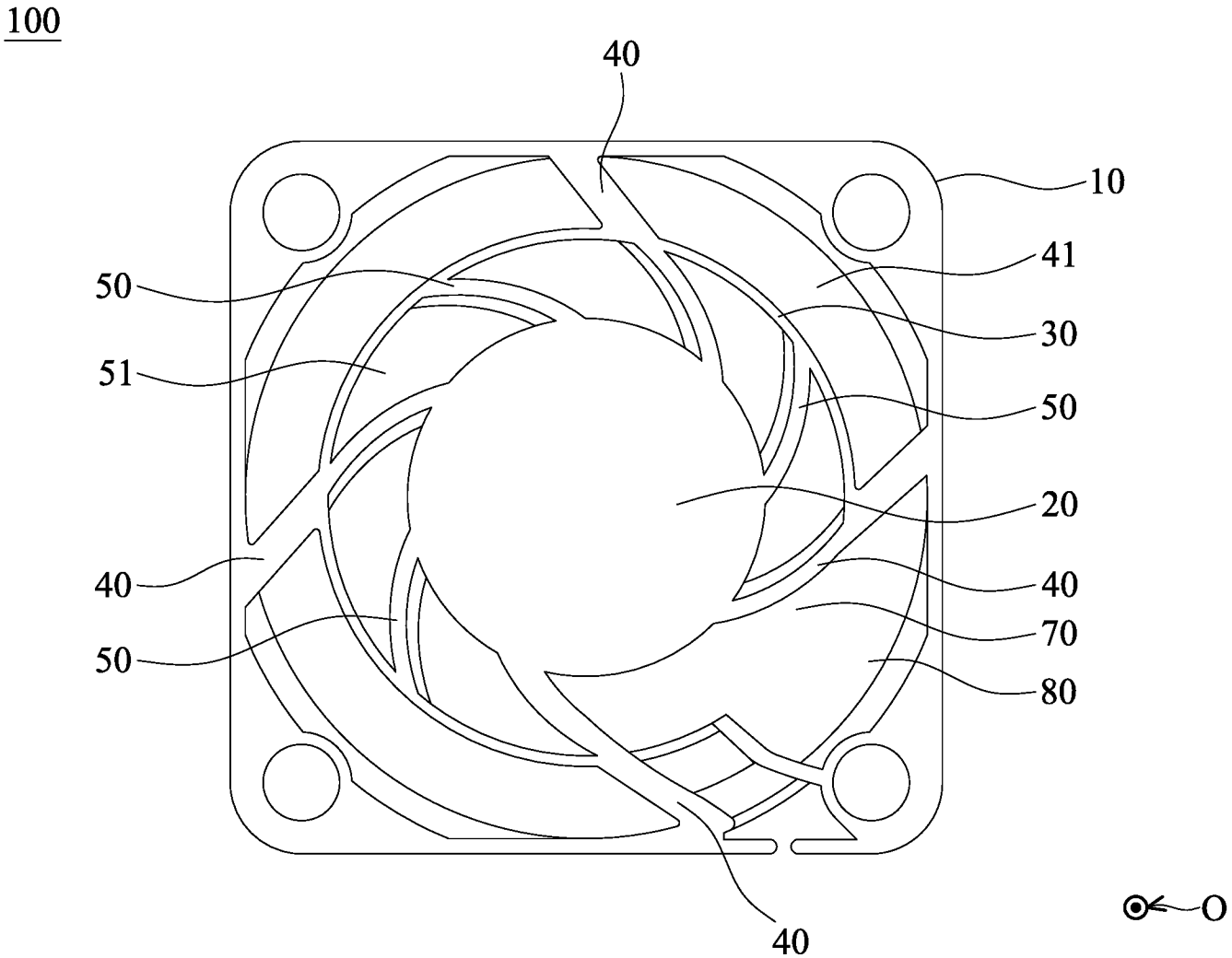
FIG. 2 is a bottom view of the fan frame 100 in accordance with a first embodiment of the invention.

Referring to FIG. 1, the fan frame 100 in this embodiment can be applied to an axial fan device that comprises a rotator assembly 300 (including a motor) and a bearing system 200 for supporting the rotator assembly 300. Here, the bearing system 200 is mounted at the center portion (the shaft seat 20 as shown in FIG. 2) of the fan frame 100. An air inlet 110 is formed on the first side S1 of the fan frame 100, and an air outlet 120 is formed on the second side S2 of the fan frame 100.

After assembly of the axial fan device, the rotator assembly 300 can rotate so that air flows into the axial fan device through the air inlet 110 along the air-inlet direction I. Subsequently, air flows out of the axial fan device through the air outlet 120 along the air-outlet direction O. It should be noted that the air-outlet direction O extends out of the paper in FIGS. 2-11, and the air-inlet direction I and the air-outlet direction O are substantially the same direction.

First Embodiment

FIG. 2 is a bottom view of the fan frame 100. The fan frame 100 comprises a housing 10, a shaft seat 20, at least one curved rib 30, several first ribs 40, and several second ribs 50. Here, the number of the curved rib 30 is one, the number of the first ribs 40 is four, and the number of the second ribs 50 is three.

As shown in FIG. 2, the shaft seat 20 is disposed at the center portion of the housing 10. The curved rib 30 is disposed between the housing 10 and the shaft seat 20. The first ribs 40 extend through the curved rib 30 and connect the shaft seat 20 to the housing 10. Moreover, the second ribs 50 are connected between the shaft seat 20 and the curved rib 30.

As mentioned above, the air-outlet direction O extends out of the paper in FIGS. 2-11. The surface of the shaft seat 20 is perpendicular to the air-outlet direction O, and the first and second ribs 40 and 50 are also perpendicular to the air-outlet direction O.

Specifically, the curved rib 30 forms an opening 70. That is, the curved rib 30 has a C-shaped structure in this embodiment. Furthermore, a connector hole 80 is formed between the opening 70 and the housing 10. During assembly, conductive wires or terminals can be installed through the connector hole 80, thereby facilitating easy assembly of the fan device.

The portions of the fan frame 100 may comprise different materials. In some embodiments, the housing 10 may comprise plastic material that has high mechanical strength (e.g. PET, GF or the combination thereof). The first and second ribs 40 and 50 may comprise anti-vibration material, such as EPDM or rubber. The curved rib 30 may comprise metal material, such as SECC. As different portions of the fan frame 100 have different materials, the fan frame 100 can have high structural strength with low noise during usage.

Figure 3:
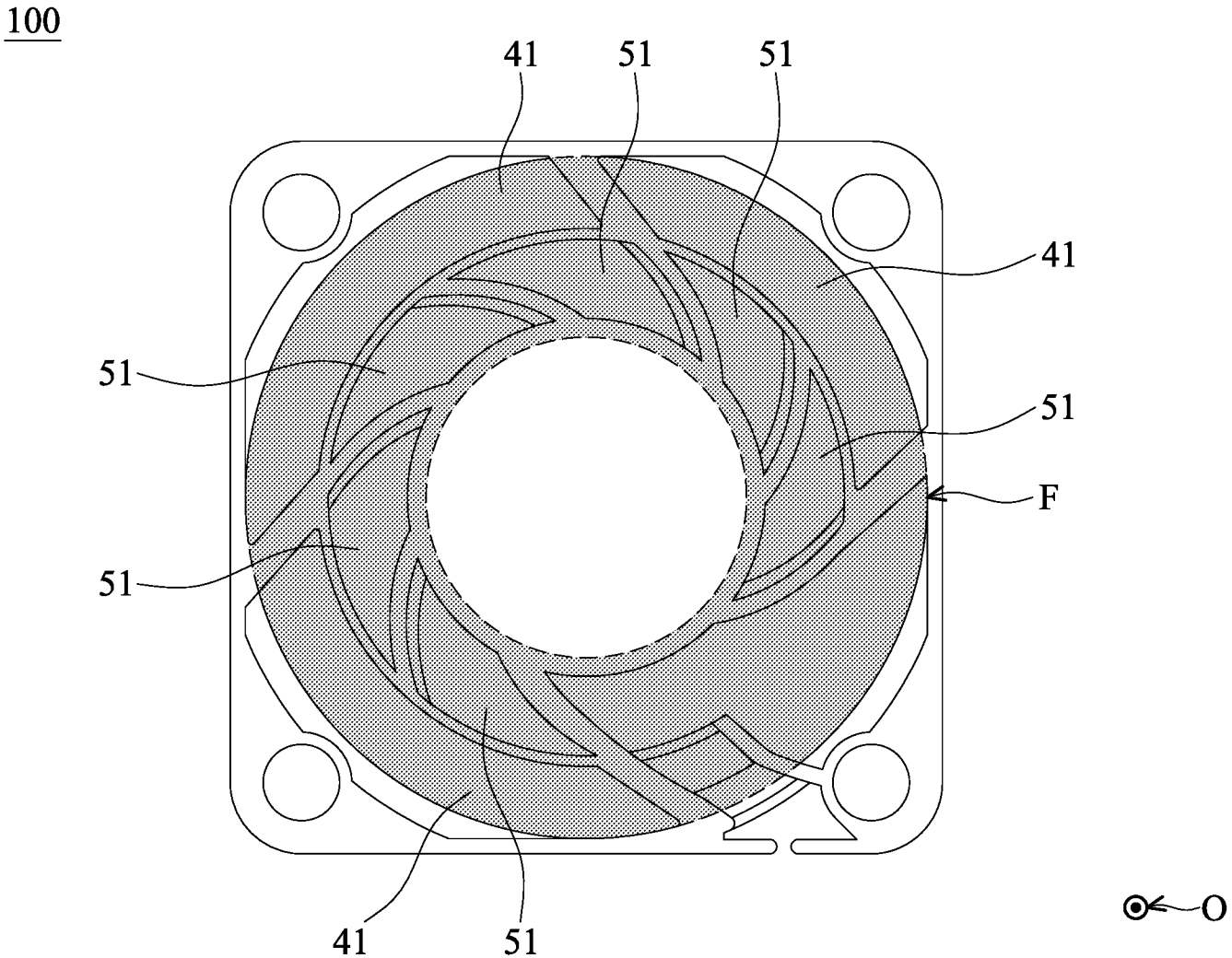
FIG. 3 is a schematic diagram showing the airflow area F of the fan frame 100.

Referring to FIGS. 2 and 3, several first holes 41 can be defined by the first ribs 40 and the curved rib 30. Several second holes 51 can be defined by the second ribs 50 and the curved rib 30.

As shown in FIG. 3, the first and second holes 41 and 51 define an airflow area F. The first holes 41 are located on the outer side of the curved rib 30, and the second holes 51 are located on the inner side of the curved rib 30.

Figure 4:
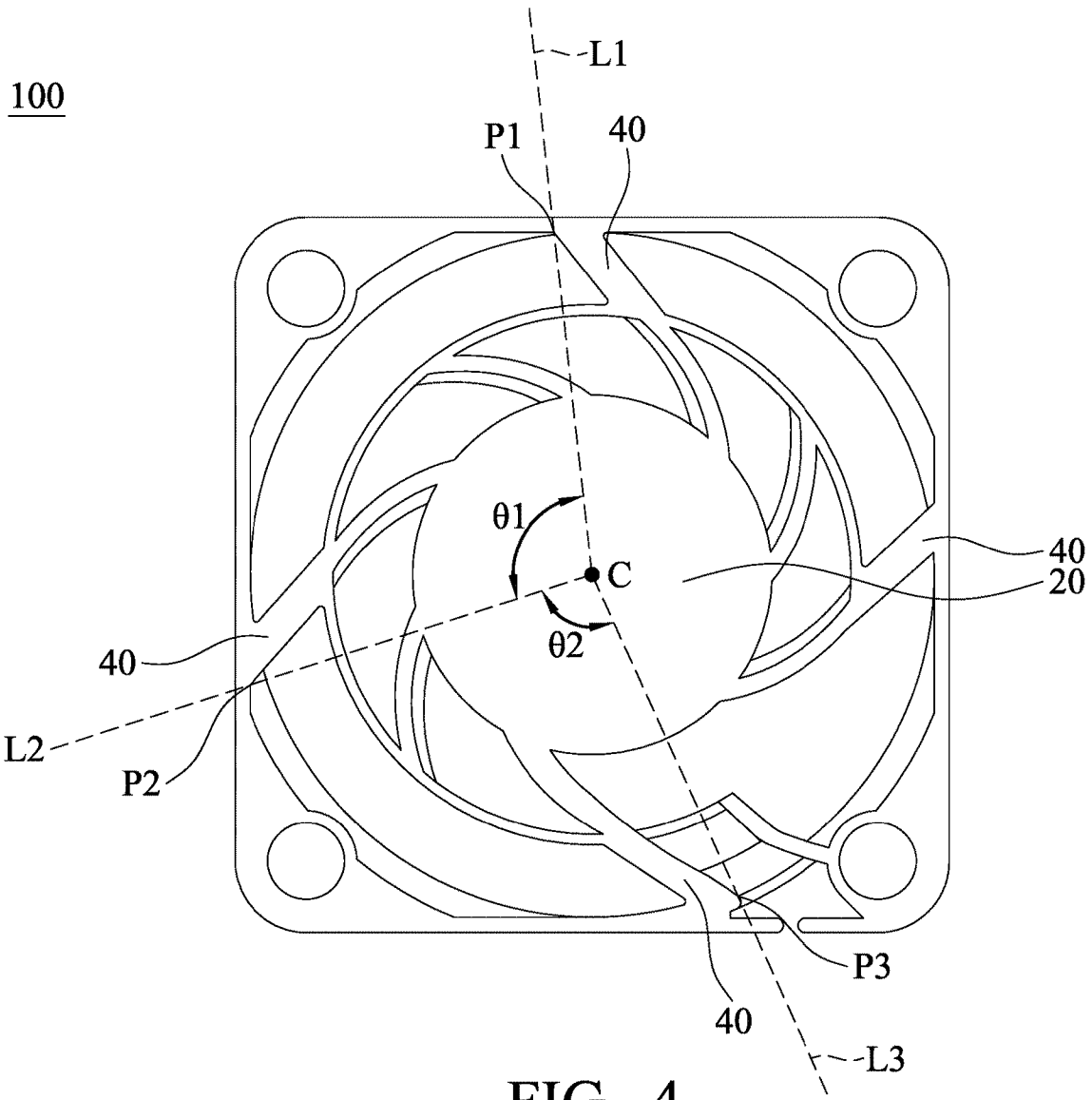
FIG. 4 is a schematic diagram showing the first ribs 40 are arranged around the shaft seat 20 (center point C) of the fan frame 100 in a symmetrical manner.

In this embodiment, the first ribs 40 are arranged around the shaft seat 20 (center point C) of the fan frame 100 in a symmetrical manner, as shown in FIG. 4.

It can be seen in FIG. 4 that the shaft seat 20 has a center point C, and three broken lines L1, L2, and L3 connect the center point C to the end points P1, P2, and P3 on the counterclockwise side of the three first ribs 40, respectively. In some embodiments, the broken lines L1, L2, and L3 may connect the center point C to the end points on the clockwise side of the three first ribs 40, and the invention is not limited to the embodiments.

Still referring to FIG. 4, when taking the center point C as the origin of an angular coordinate, the two first ribs 40 on the left and top sides of the fan frame 100 form a first included angle θ1, and the two first ribs 40 on the left and lower sides of the fan frame 100 form a second included angle θ2 that is equal to the first included angle θ1. In this embodiment, the first ribs 40 are arranged symmetrically around the shaft seat 20 (center point C).

Figure 5:
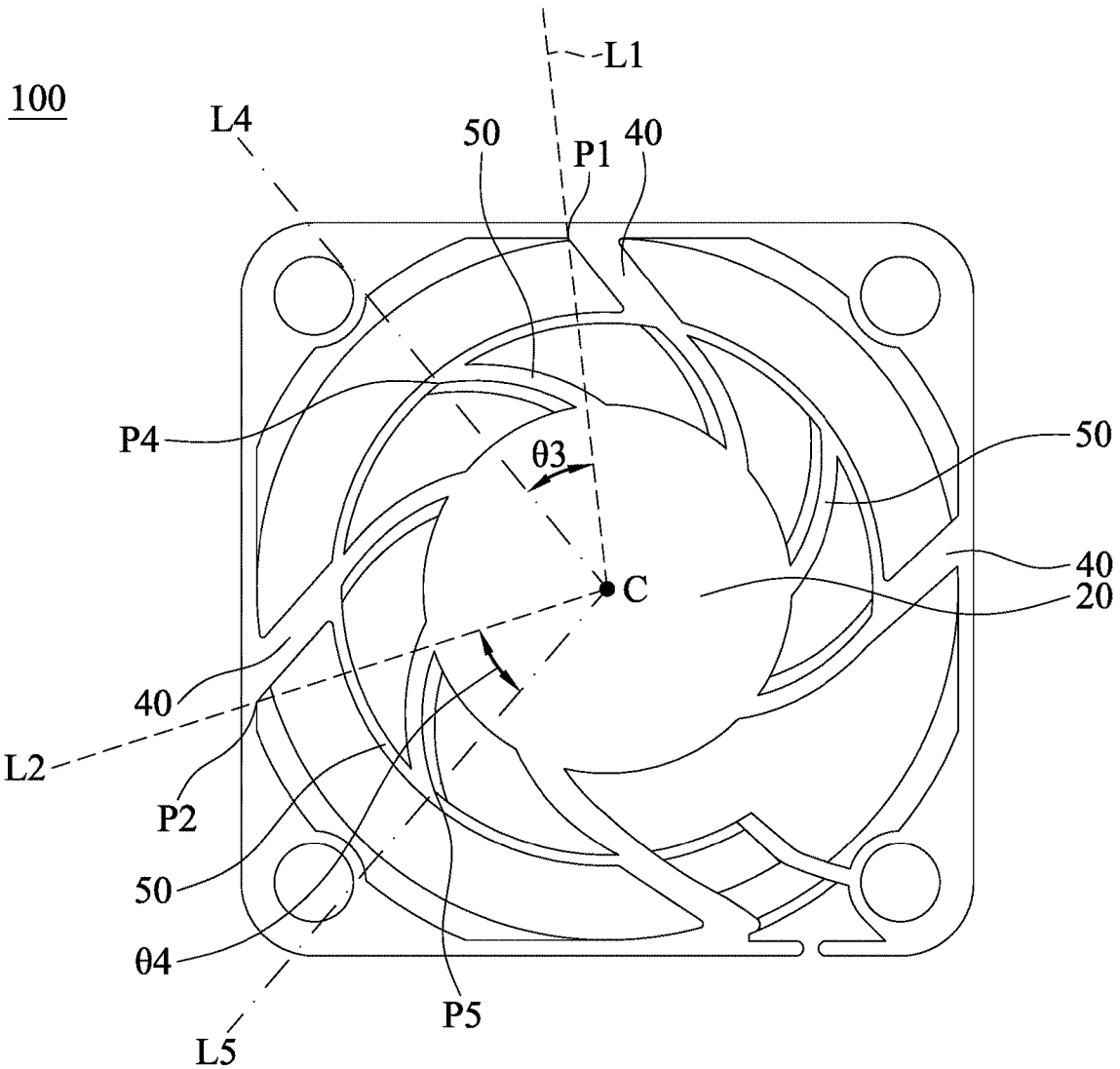
FIG. 5 is a schematic diagram showing the second ribs 50 are arranged around the shaft seat 20 (center point C) of the fan frame 100 in a symmetrical manner.

FIG. 5 shows the second ribs 50 of the fan frame 100 arranged at the same interval around the shaft seat 20 (center point C).

As shown in FIG. 5, the shaft seat 20 has a center point C, and the broken lines L1 and L2 connect the center point C to the end points P1 and P2 on the counterclockwise side of the three first ribs 40, respectively. Furthermore, another two broken lines L4 and L5 connect the center point C to the end points P4 and P5 on the counterclockwise side of the second ribs 50. In some embodiments, however, the broken lines L4 and L5 may connect the center point C to the end points on the clockwise side of the second ribs 50, and the invention is not limited to the embodiments.

When taking the center point C as the origin of an angular coordinate, the second rib 50 on the top side of the fan frame 100 and the first rib 40 most close thereto define a third included angle θ3. Similarly, the second rib 50 on the lower-left side of the fan frame 100 and the first rib 40 most close thereto define a fourth included angle θ4. Here, the fourth included angle θ4 is equal to the third included angle θ3, and the second ribs 50 are symmetrically arranged around the shaft seat 20 and located between the inner side of the curved rib 30 and the outer side of the shaft seat 20 (center point C).

Figure 6:
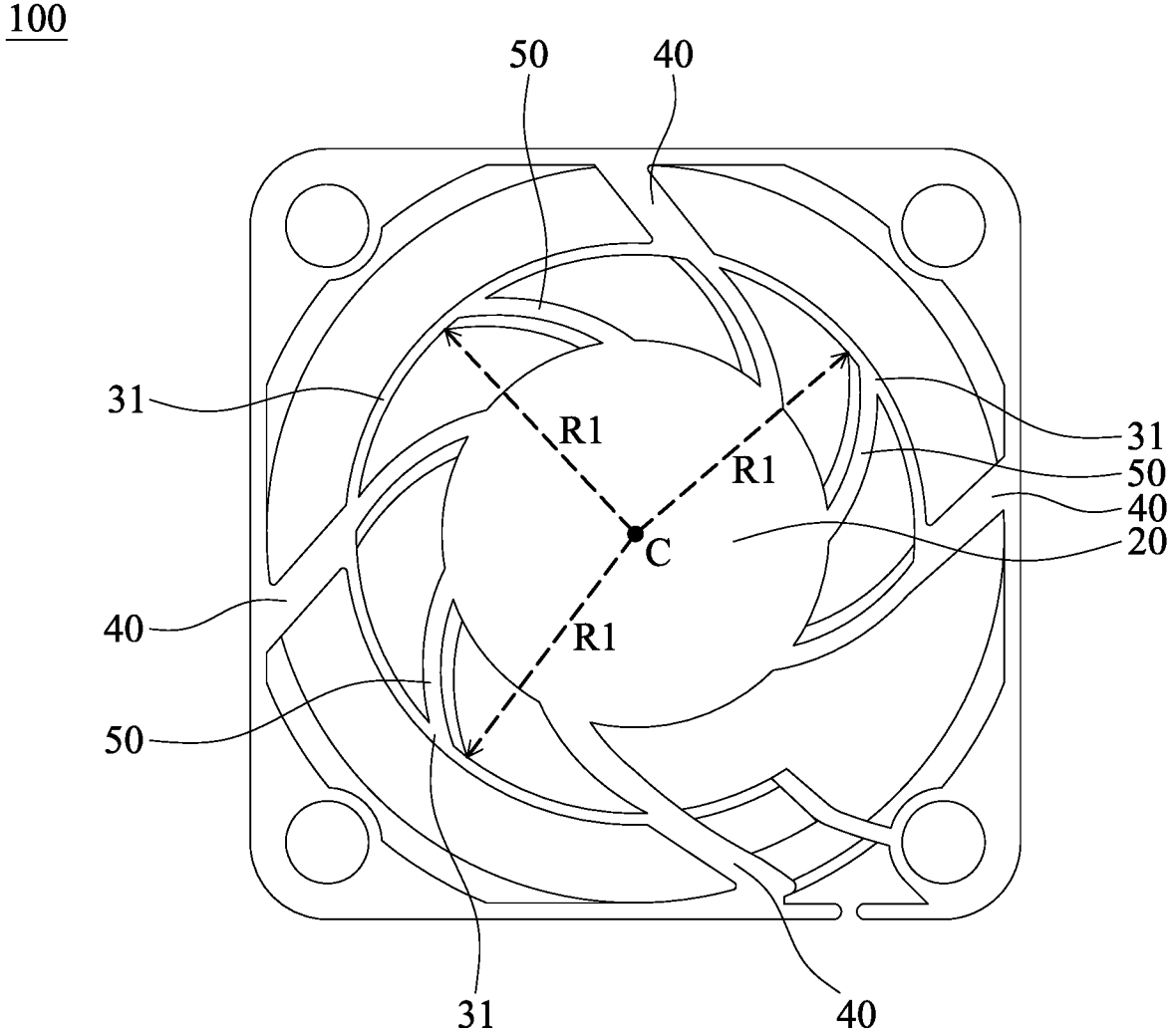
FIG. 6 is a schematic diagram showing the curved rib 30 of the fan frame 100 has several arc portions 31 symmetrically arranged around the shaft seat 20 (center point C).

FIG. 6 shows the curved rib 30 of the fan frame 100 that has several arc portions 31 symmetrically arranged around the shaft seat 20 (center point C).

As shown in FIG. 6, the shaft seat 20 has a center point C, and the curved rib 30 is divided into several arc portions 31 by the first ribs 40. In this embodiment, the arc portions 31 have the same length, and the number of the arc portions 31 is three. It can be seen in FIG. 6 that all of the arc portions 31 have a radius R1 with respect to the center point C of the shaft seat 20. Since the arc portions 31 have the same length and radius, they are arranged in a symmetrical manner around the shaft seat 20 (center point C).

Specifically, in FIG. 6, the radius R1 is defined between the center point C and the inner edge of the arc portions 31. In some embodiments, however, the radius R1 may be defined between the center point C and the outer edge of the arc portions 31, and the invention is not limited to the embodiments.

In this configuration, the first and second holes 41 and 51 can be formed to regulate the air flow. Therefore, the air flow rates through the holes within the airflow area F are substantially the same, and the variation of flow rate within the airflow area F can be efficiently reduced.

Since the housing and the shaft seat 20 are connected via the curved rib 30, the first ribs 40, and the second ribs 50, the mechanical strength of the fan frame 100 can be greatly improved. Hence, deformation of the fan frame 100 can be reduced 30% than the conventional fan frame structure when an external force is applied. Moreover, in the condition of the same rotational speed of fan, the noise of the fan device in the present embodiment can be reduced 2 dB-A than the prior art. Additionally, the air flow in the present embodiment can be increased 10% than the prior art when they produce the same amount of noise, and the axial fan device provided with the fan frame 100 can have better heat dissipation performance than the conventional fan devices.

Second Embodiment

Figure 7:
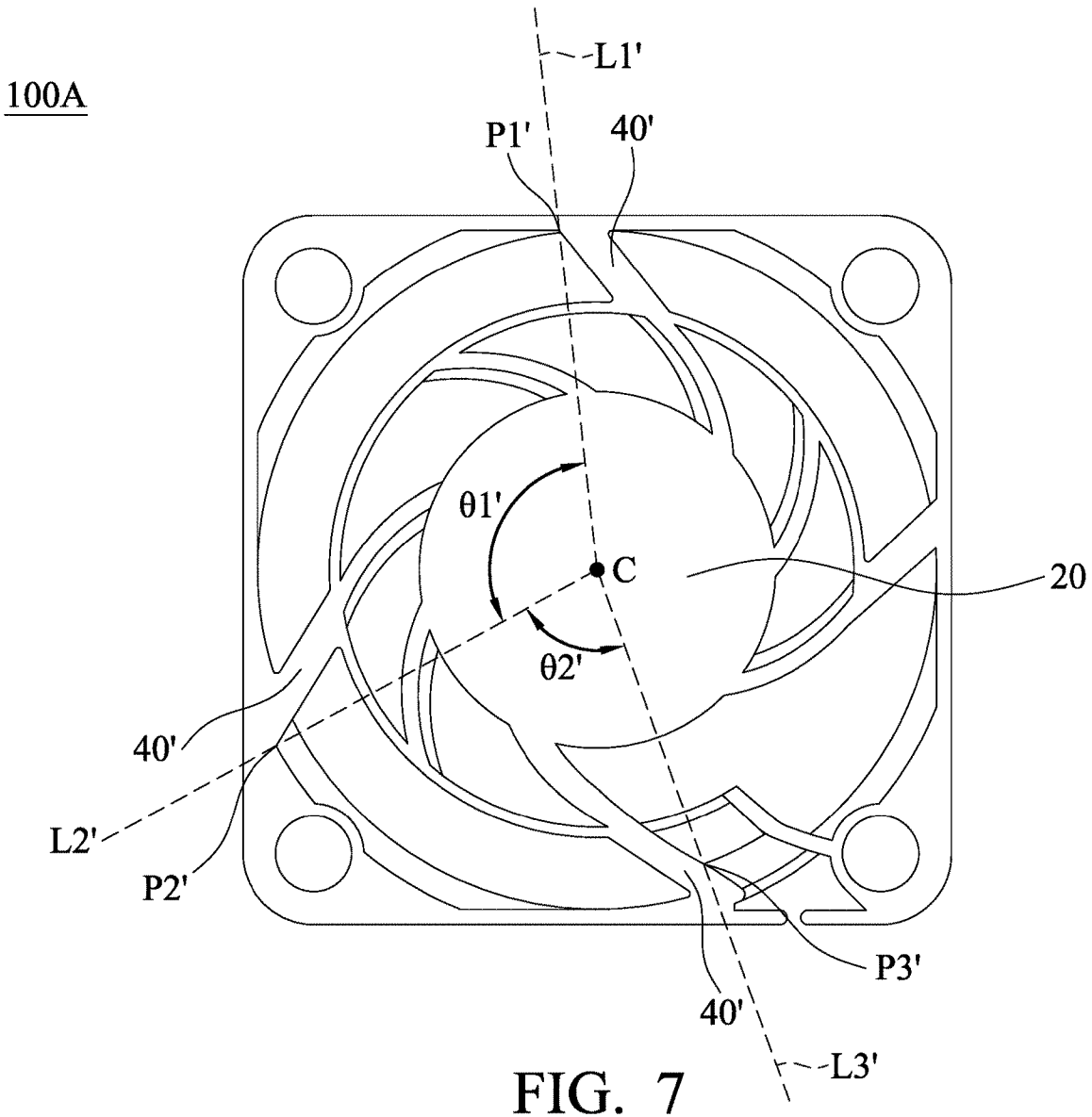
FIG. 7 is a schematic diagram showing the first ribs 40' of the fan frame 100A that are not symmetrically arranged around the shaft seat 20 (center point C), in accordance with a second embodiment of the invention.

FIG. 7 is a bottom view of a fan frame 100A, in accordance with a second embodiment of the invention. Since the configuration of the present modified example other than the above is substantially the same as the configuration of the first embodiment, the same elements are denoted by the same reference numerals, and descriptions thereof will not be repeated. In FIG. 7, it is emphasized that the first ribs 40' of the fan frame 100A are not symmetrically arranged around the shaft seat 20 (center point C).

It can be seen in FIG. 7 that when taking the center point C as the origin of an angular coordinate, three broken lines L1', L2', and L3' connect the center point C to the end points P1', P2', and P3' on the counterclockwise side of the three first ribs 40', respectively. Hence, the two first ribs 40' on the left and top sides of the fan frame 100A form a first included angle θ1', and the two first ribs 40' on the left and lower sides of the fan frame 100A form a second included angle θ2' that is not equal to the first included angle θ1. Therefore, the first ribs 40' of the fan frame 100A are not symmetrically arranged around the shaft seat 20 (center point C).

In this embodiment, the position of the first rib 40' on the left side of the fan frame 100A differs from that of the first rib 40 in the first embodiment. Hence, the first ribs 40' are not arranged around the shaft seat 20 in a symmetrical manner. In some embodiments, however, the position of one or more first ribs 40' may be changed so that they are arranged around the shaft seat 20 in an asymmetrical manner.

With the configuration of FIG. 7, the fan device in the second embodiment can achieve the same performance as the first embodiment, and the variation of flow rate within the airflow area F can be efficiently reduced by arranging the first ribs 40' in an asymmetrical manner around the shaft seat 20.

Third Embodiment

Figure 8:
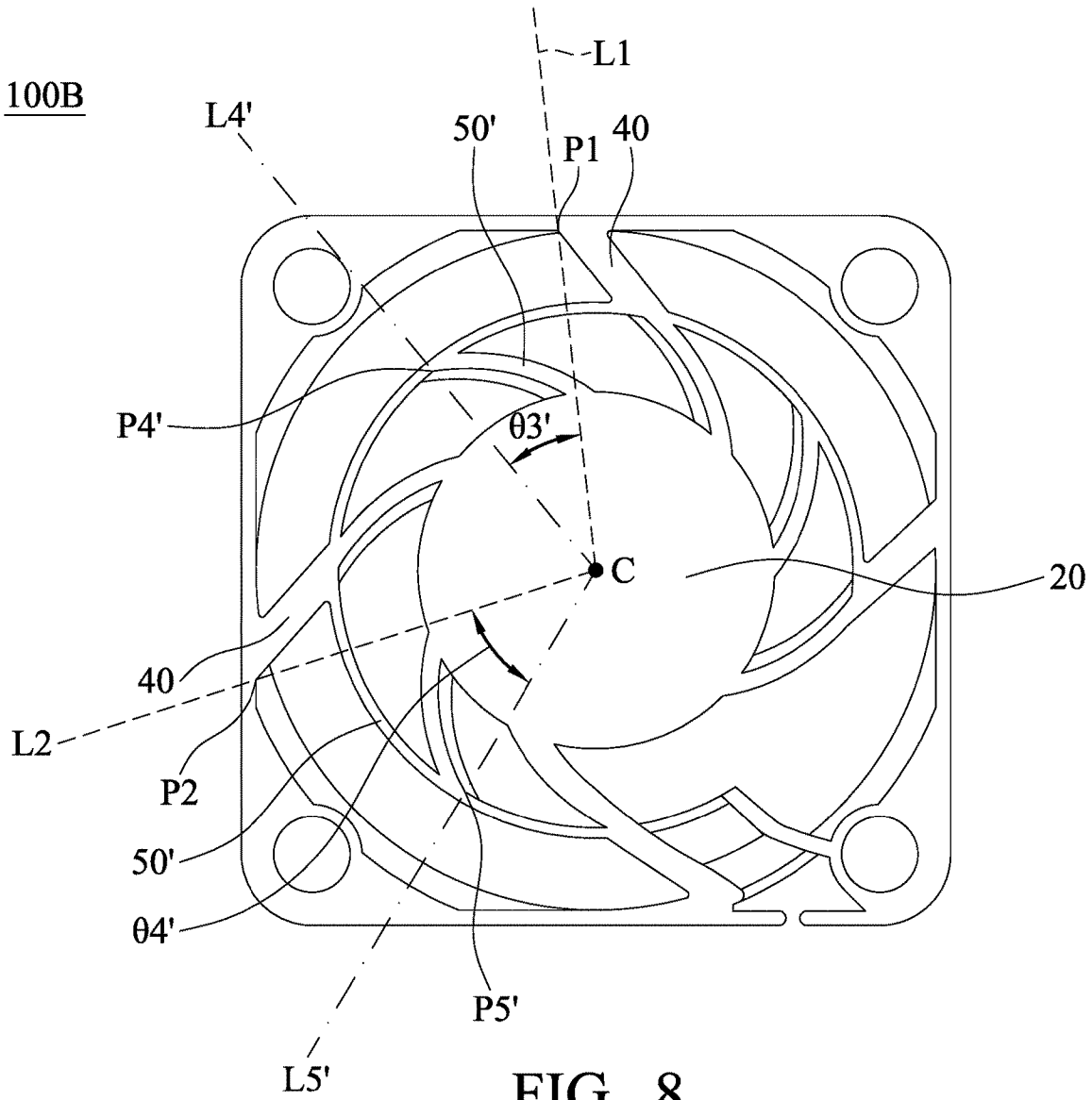
FIG. 8 is a schematic diagram showing the second ribs 50' of the fan frame 100B that are not symmetrically arranged around the shaft seat 20 (center point C), in accordance with a third embodiment of the invention.

FIG. 8 is a bottom view of a fan frame 100B, in accordance with a third embodiment of the invention. Since the configuration of the present modified example other than the above is substantially the same as the configuration of the first and second embodiments, the same elements are denoted by the same reference numerals, and descriptions thereof will not be repeated. In FIG. 8, it is emphasized that the second ribs 50' of the fan frame 100B are not symmetrically arranged around the shaft seat 20 (center point C).

It can be seen in FIG. 8 that when taking the center point C as the origin of an angular coordinate, two broken lines L1 and L2 connect the center point C to the end points P1 and P2 on the counterclockwise side of the three first ribs 40, respectively. Furthermore, in this embodiment, two broken lines L4' and L5' connect the center point C to the end points P4' and P5' on the counterclockwise side of the second ribs 50.

Hence, the second rib 50' on the top side of the fan frame 100B and the first rib 40 most close thereto define a third included angle θ3'. Similarly, the second rib 50' on the lower-left side of the fan frame 100B and the first rib 40 most close thereto define a fourth included angle θ4'. Here, the fourth included angle 84' is not equal to the third included angle θ3', and the second ribs 50' are arranged between the inner side of the curved rib 30 and the outer side of the shaft seat 20 (center point C) in an asymmetrical manner.

In this embodiment, the first ribs 40 are arranged around the shaft seat 20 in a symmetrical manner, and the same elements in the first and third embodiments are denoted by the same reference numerals.

Specifically, in the third embodiment, the position of the second rib 50' on the lower-left side of the fan frame 100B differs from that of the second rib 50 in the first embodiment. Hence, the second ribs 50' are not arranged around the shaft seat 20 in a symmetrical manner. In some embodiments, the position of one or more second ribs 50' may be changed so that they are arranged around the shaft seat 20 in an asymmetrical manner.

With the configuration of FIG. 8, the fan device in the third embodiment can achieve the same performance as the first embodiment, and the variation of flow rate within the airflow area F can be efficiently reduced by arranging the second ribs 50' in an asymmetrical manner around the shaft seat 20.

Fourth Embodiment

Figure 9:
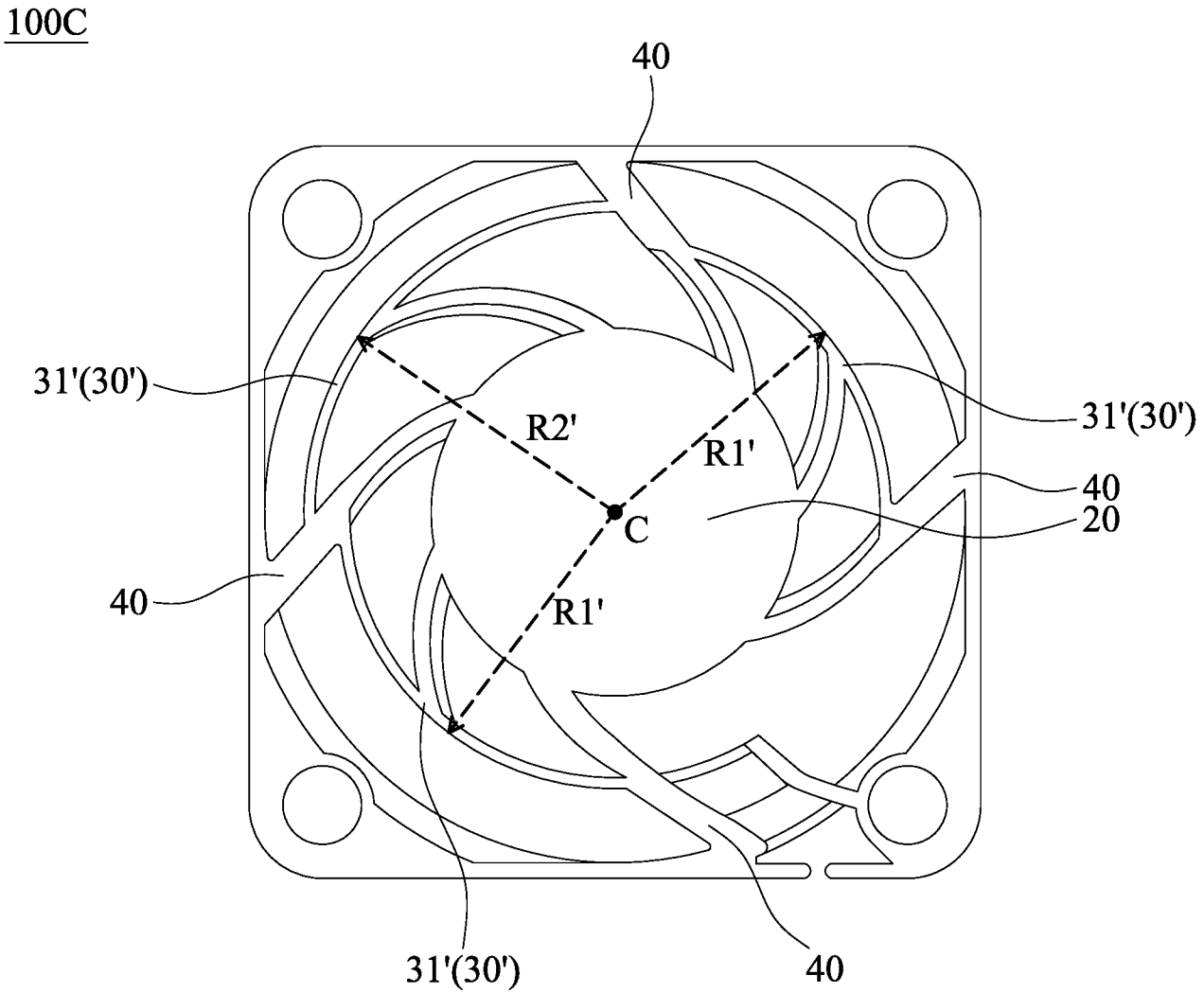
FIG. 9 is a schematic diagram showing the curved rib 30' of the fan frame 100C has several arc portions 31' that are not symmetrically arranged around the shaft seat 20 (center point C), in accordance with a fourth embodiment of the invention.

FIG. 9 is a bottom view of a fan frame 100C, in accordance with a fourth embodiment of the invention. Since the configuration of the present modified example other than the above is substantially the same as the configuration of the first, second, and third embodiments, the same elements are denoted by the same reference numerals, and descriptions thereof will not be repeated. In FIG. 9, it is emphasized that the curved rib 30' of the fan frame 100C has several arc portions 31' that are not symmetrically arranged around the shaft seat 20 (center point C).

It can be seen in FIG. 9 that the shaft seat 20 of the fan frame 100C has a center point C, and the curved rib 30' is divided into several arc portions 31' by the first ribs 40. In the fourth embodiment, the arc portion 31' on the upper-left side of the fan frame 100C is longer than the other two arc portions 31' that have the same length. Specifically, the arc portion 31' on the upper-left side of the fan frame 100C has a radius R2', and the other two arc portions 31' have a radius R1', wherein R2'>R1'. Since the arc portions 31' of the curved rib 30' in FIG. 9 have different lengths and radiuses, they are arranged in an asymmetrical manner around the shaft seat 20 (center point C).

In FIG. 9, the radius is defined between the center point C and the outer edge of the arc portions 31'. In some embodiments, however, the radius may be defined between the center point C and the inner edge of the arc portions 31', and the invention is not limited to the embodiments.

In this embodiment, the first ribs 40 are arranged around the shaft seat 20 in a symmetrical manner, and the same elements in the first and fourth embodiments are denoted by the same reference numerals.

Since the arc portion 31' on the upper-left side of the fan frame 100C has a large radius with respect to the center point C, all of the arc portions 31' are arranged in an asymmetrical manner around the shaft seat 20 (center point C). In some embodiments, the radius of one or more arc portions 31' may be changed so that they are arranged around the shaft seat 20 in an asymmetrical manner.

With the configuration of FIG. 9, the fan device in the fourth embodiment can achieve the same performance as the first embodiment, and the variation of flow rate within the airflow area F can be efficiently reduced by arranging the arc portions 31' of the curved rib 30' in an asymmetrical manner around the shaft seat 20. Moreover, with the enlarged arc portion 31' of the curved rib 30', the mechanical strength of the fan frame 100C can also be improved.

Fifth Embodiment

Figure 10:
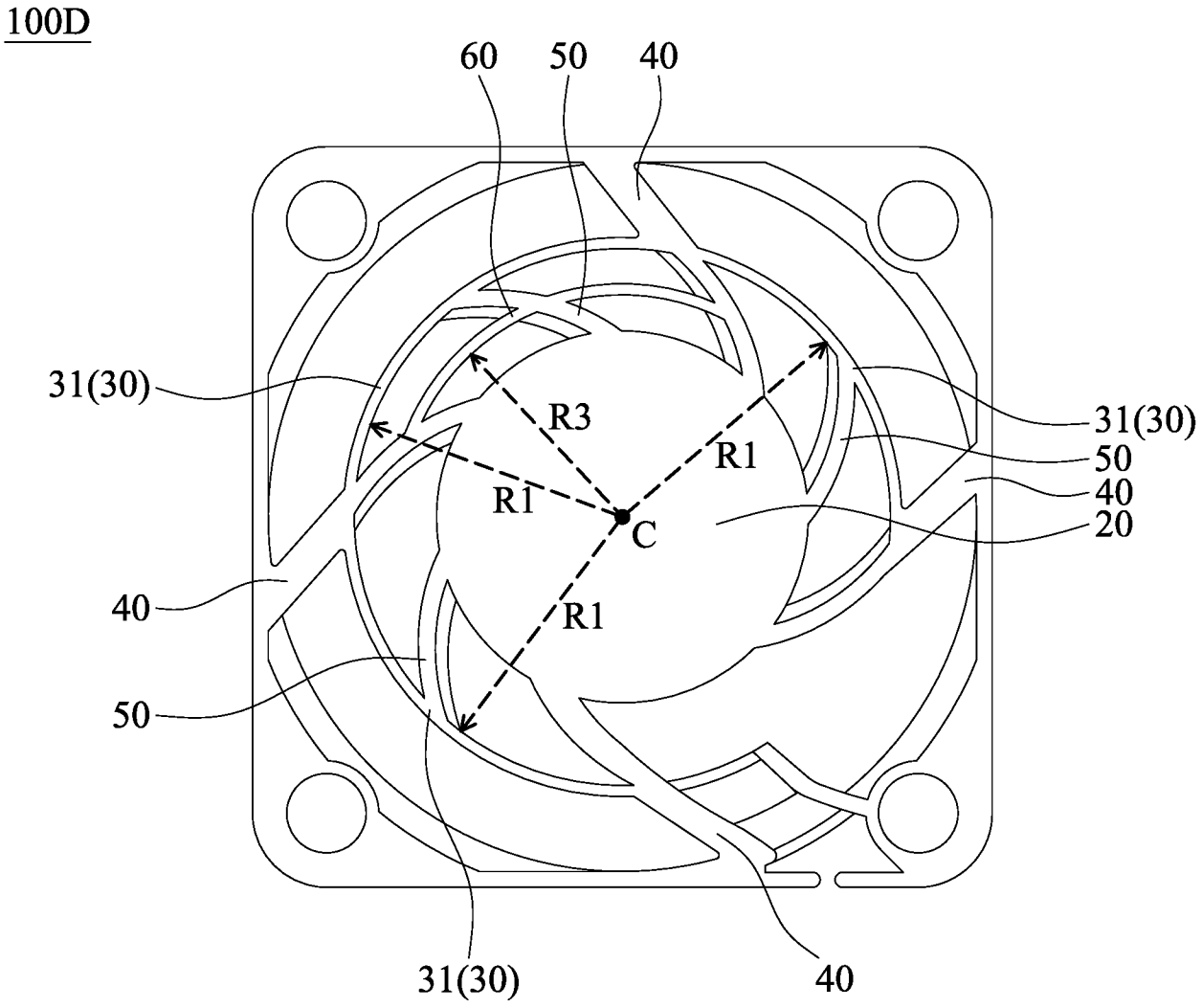
FIG. 10 is a schematic diagram showing the fan frame 100D further comprises an auxiliary curved rib 60, in accordance with a fifth embodiment of the invention.

FIG. 10 is a bottom view of a fan frame 100D, in accordance with a fifth embodiment of the invention. Since the configuration of the present modified example other than the above is substantially the same as the configuration of the first, second, third, and fourth embodiments, the same elements are denoted by the same reference numerals, and descriptions thereof will not be repeated. In FIG. 10, it is emphasized that the fan frame 100D further comprises an auxiliary curved rib 60.

It can be seen in FIG. 10 that the shaft seat 20 of the fan frame 100D has a center point C, and the arc portions 31 of the curved rib 30, the first ribs 40, and the second ribs 50 are arranged symmetrically around the shaft seat 20 (center point C), wherein the same elements in the first and fifth embodiments are denoted by the same reference numerals. Moreover, in this embodiment, the arc portions 31 have the same radius R1.

Still referring to FIG. 10, the fan frame 100D comprises an auxiliary curved rib 60 disposed between the shaft seat 20 and the curved rib 30. In this embodiment, the auxiliary curved rib 60 is located between the shaft seat 20 and the arc portion 31 on the upper-left side of the fan frame 100D, and the auxiliary curved rib 60 has a radius R3 less than the radius R1 of the arc portions 31.

In the fifth embodiment, the auxiliary curved rib 60 is located between the shaft seat 20 and the arc portion 31 on the upper-left side of the fan frame 100D, but the invention is not limited thereto. In some embodiments, the auxiliary curved rib 60 may be disposed between shaft seat 20 and the other arc portions 31. In some embodiments, the auxiliary curved rib 60 may extend across two or more arc portions 31, and it can be divided into several second arc portions by the second ribs 50, wherein the second arc portions may have the same or different radiuses.

With the configuration of FIG. 10, the fan device in the fifth embodiment can achieve the same performance as the first embodiment. As the airflow area F can be further divided into several flow channels by the auxiliary curved rib 60, the variation of flow rate within the airflow area F can be efficiently reduced. Moreover, the mechanical strength of the fan frame 100D can also be enhanced by the auxiliary curved rib 60.

Sixth Embodiment

Figure 11:
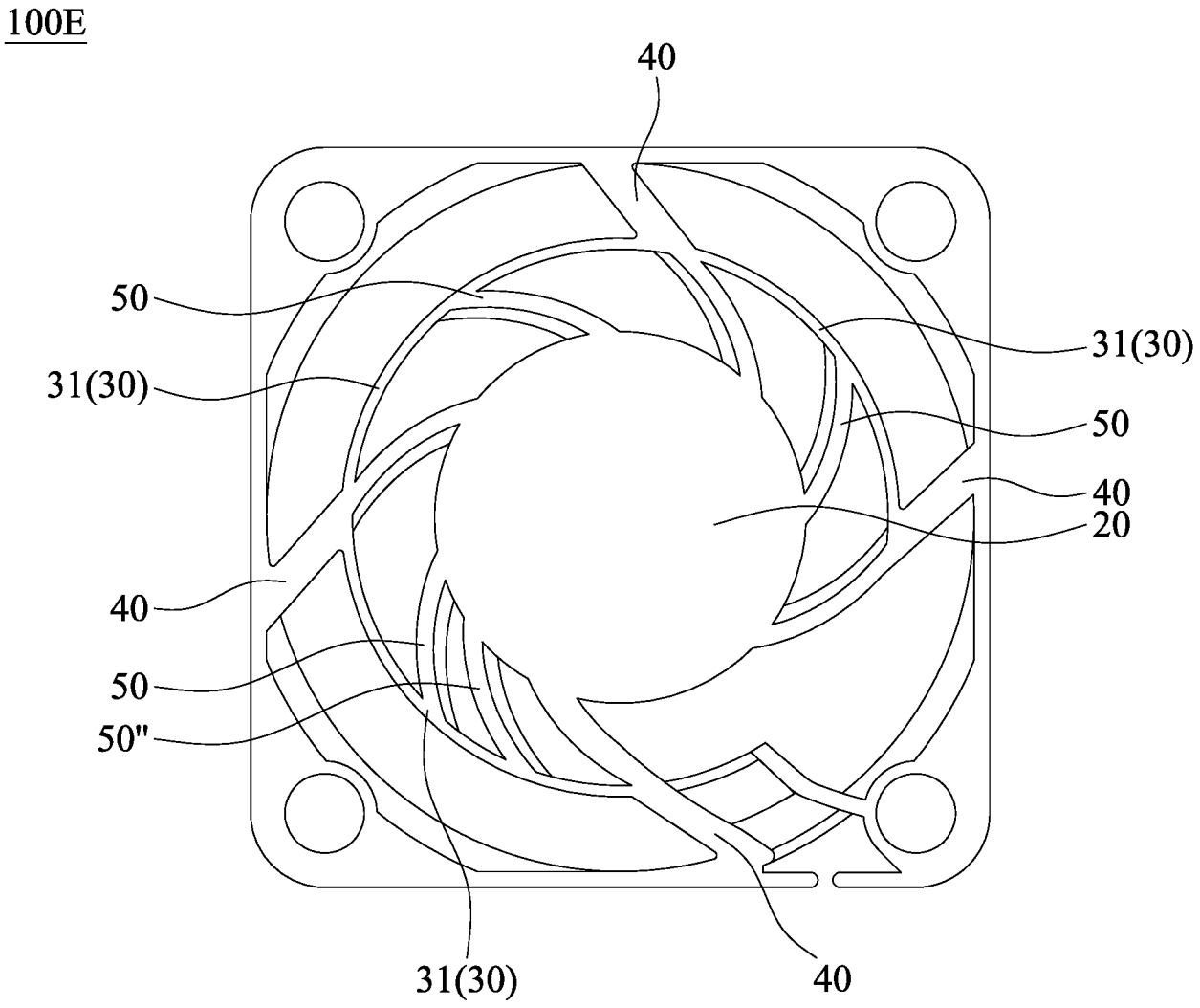
FIG. 11 is a schematic diagram showing the fan frame 100E comprises a plurality of second ribs 50 and 50" located between the two adjacent first ribs 40, in accordance with a sixth embodiment of the invention.

FIG. 11 is a bottom view of a fan frame 100E, in accordance with a sixth embodiment of the invention. Since the configuration of the present modified example other than the above is substantially the same as the configuration of the first, second, third, fourth, and fifth embodiments, the same elements are denoted by the same reference numerals, and descriptions thereof will not be repeated. In FIG. 11, it is emphasized that the fan frame 100E comprises the second ribs 50 and 50".

In the first to fifth embodiments, the first and second ribs 40 and 50 are arranged in a staggered manner around the shaft seat 20. That is, each second rib 50 is disposed between the adjacent first ribs 40.

It can be seen in FIG. 11 that the arc portions 31 of the curved rib 30, the first ribs 40, and the second ribs 50 are arranged symmetrically around the shaft seat 20, and the same elements in the first and sixth embodiments are denoted by the same reference numerals. In the sixth embodiment, two second ribs 50 and 50" are disposed between the two adjacent first ribs 40 on the left and lower sides of the fan frame 100E, however, only one second rib 50 is disposed between the other adjacent ribs 40.

In some embodiments, three or more second ribs 50 and 50" may be disposed between two adjacent first ribs 40, and different number of second ribs 50 and 50" may be interposed in the intervals among the first ribs 40. However, the invention is not limited to the embodiments.

With the configuration of FIG. 11, the fan device in the sixth embodiment can achieve the same performance as the first embodiment. Since the airflow area F can be further divided into several flow channels by the second ribs 50 and 50", the variation of flow rate within the airflow area F can be efficiently reduced. Moreover, the mechanical strength of the fan frame 100E can also be enhanced by the second rib 50".

Other Embodiments

In the first embodiment to the sixth embodiment, the number of the first ribs 40 is four. However, the number of the first ribs 40 may be five or more, and the invention is not limited to the embodiments.

In the fourth embodiment, the three arc portions 31 and 31' have two different radiuses R1' and R2'. However, the three arc portions 31 and 31' may have three radiuses different from each other, and the invention is not limited to the embodiments.

In the first to the sixth embodiments, the shape and number of the curved ribs, the first ribs, and the second ribs may be modified, and the invention is not limited to the embodiments.

Although some embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, compositions of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. Moreover, the scope of the appended claims should be accorded the broadest interpretation so as to encompass all such modifications and similar arrangements.

While the invention has been described by way of example and in terms of preferred embodiment, it should be understood that the invention is not limited thereto. On the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A fan frame, comprising:

a housing, having an air inlet and an air outlet, wherein the air inlet is on a first side of the housing, and the air outlet is on a second side of the housing;

a shaft seat, disposed at the center of the housing;

at least one curved rib, disposed between the housing and the shaft seat;

a plurality of first ribs, extending through the curved rib and connecting the shaft seat to the housing, wherein the first ribs and the curved rib define a plurality of first holes; and a plurality of second ribs, connecting the curved rib to the shaft seat, wherein the second ribs and the curved rib define a plurality of second holes, wherein the first and second holes form an airflow area of the fan frame;

wherein air flows through the air inlet along an air-inlet direction, and air is discharged from the fan frame through the air outlet along an air-outlet direction that is the same as the air-inlet direction.

2. The fan frame as claimed in claim 1, wherein the first ribs are arranged around the shaft seat in a symmetrical manner.

3. The fan frame as claimed in claim 1, wherein the shaft seat has a center point, and when taking the center point as the origin of an angular coordinate, one of the first ribs is located between and adjacent to another two of the first ribs, wherein a first included angle and a second included angle are defined by the three first ribs, and the first included angle is not equal to the second included angle.

4. The fan frame as claimed in claim 1, wherein the second ribs are arranged around the shaft seat in a symmetrical manner and located between the inner side of the curved rib and the outer side of the shaft seat.

5. The fan frame as claimed in claim 1, wherein the shaft seat has a center point, and when taking the center point as the origin of an angular coordinate, a third included angle is formed between one of the second ribs and one of the first ribs that are close to each other, and a fourth included angle is formed between another one of the second ribs and another one of the first ribs that are close to each other, wherein the fourth included angle is not equal to the third included angle.

6. The fan frame as claimed in claim 1, wherein the curved rib is divided into a plurality of arc portions by the first ribs, and the arc portions have the same length.

7. The fan frame as claimed in claim 1, wherein the curved rib is divided into a plurality of arc portions by the first ribs, and at least one of the arc portions has a different length than the other arc portions.

8. The fan frame as claimed in claim 1, wherein the curved rib is divided into a plurality of arc portions by the first ribs, and the shaft seat has a center point, wherein when taking the center point as the origin of an angular coordinate, at least one of the arc portions has a radius with respect to the center point that is greater than the other arc portions.

9. The fan frame as claimed in claim 1, further comprising an auxiliary curved rib disposed between the curved rib and the shaft seat.

10. The fan frame as claimed in claim 1, wherein the first and second ribs are arranged around the shaft seat in a staggered manner.

11. The fan frame as claimed in claim 1, wherein two of the second ribs are located between two of the first ribs that are adjacent to each other.

12. The fan frame as claimed in claim 1, wherein the curved rib forms an opening, and a connector hole is formed between the opening and the housing.

* * * * *